US005513862A

United States Patent [19]

Chuang

[11] Patent Number: 5,513,862

[45] Date of Patent: May 7, 1996

[54] SKATE WITH WEDGE-SHAPED HEIGHT ADJUSTER

[76] Inventor: Chien-Hsiung Chuang, 4943 Twin Branches Way, Dunwoody, Ga. 30338

[21] Appl. No.: 346,099

[22] Filed: Nov. 29, 1994

[51] Int. Cl.[6] ..... A63C 17/04

[52] U.S. Cl. ..... 280/11.22; 280/11.27; 280/11.16

[58] Field of Search ..... 280/11.12, 11.15, 280/11.16, 11.18, 11.19, 11.22, 11.23, 11.27, 11.28

[56] References Cited

U.S. PATENT DOCUMENTS

| | | | |
|---|---|---|---|
| 2,197,455 | 2/1939 | Murray | 280/11.12 |
| 3,339,936 | 9/1967 | Hamlin | 280/11.23 |
| 3,988,124 | 10/1976 | Babcock . | |
| 4,139,209 | 2/1979 | Humphreys | 280/11.12 |
| 4,844,491 | 7/1989 | Wheelwright | 280/11.2 |
| 5,232,231 | 8/1993 | Carlsmith | 280/11.22 |
| 5,253,884 | 10/1993 | Landers | 280/11.27 |
| 5,257,793 | 11/1993 | Fortin | 280/7.13 |
| 5,366,232 | 11/1994 | Pozzobon et al. | 280/11.22 |
| 5,405,156 | 4/1995 | Gonella | 280/11.22 |

FOREIGN PATENT DOCUMENTS

| | | | |
|---|---|---|---|
| 9312847 | 7/1993 | WIPO | 280/11.28 |

*Primary Examiner*—Margaret A. Focarino
*Assistant Examiner*—Min Yu
*Attorney, Agent, or Firm*—Deveau, Colton & Marquis

[57] ABSTRACT

A skate having a height adjustment mechanism which allows the skater to shift his or her center of gravity by varying the skate's angle of inclination relative to the skating surface, the height adjustment mechanism having a screw for moving a wedge with an inclined surface along a surface of the skate's support assembly, in order to raise or lower the skate's heel.

14 Claims, 8 Drawing Sheets

$$d\phi = sin^{-1}\left(\frac{m}{l} sin\,\alpha + \frac{n + dx\,cot\,\beta}{l} sin\,\beta\right) - sin^{-1}\left(\frac{m}{l} sin\alpha + \frac{n}{l} sin\beta\right)$$

$d\phi$ = angle changed dx = horizontal displacement

SKATE WITH WEDGE-SHAPED HEIGHT ADJUSTER

BACKGROUND OF THE INVENTION

1. Field of the Invention

The present invention relates to a skate having a height adjustment mechanism which enables the heel of the skate to be raised or lowered, thus shifting the skater's center of gravity.

2. Description of Related Art

A variety of ice and roller skates are commercially available and used for recreational and transportation purposes. For example, different types of ice-skates are available which are designed to be particularly adapted to purposes including figure skating, speed skating or hockey playing. Additionally, both traditional roller-skates having two rows of two wheels each, and in-line roller-skates having one centrally arranged row of wheels, are available.

It has been found that for a variety of reasons, adjustment of the angle of the skate boot relative to the ground, such that the skater's center of gravity is shifted forward or rearward, is desirable. In particular, when playing hockey it has been found that offensive players or "forwards" may wish to shift their center of gravity forward, such that their weight is on their toes, in a manner which enables quick acceleration in a forward direction. By contrast, defensemen who often skate backwards may prefer to shift their centers of gravity rearwards, such that their weight is on their heels. One means of allowing such adjustment to ice-skates is described by U.S. Pat. No. 3,988,124 to Babcock, wherein the metal skate blade is ground down on one end or the other to change the skate's orientation with the ice. This method suffers a disadvantage, however, in that once the blade has been ground to a particular contour, it cannot be readily adjusted without replacement or regrinding of the blade. This is particularly troublesome for "utility players" who may play a number of positions, including both offensive and defensive roles. Additionally, this method is inapplicable to roller-skates, which do not have a blade capable of adjustment by grinding.

U.S. Pat. No. 5,253,884 to Landers discloses a lever means for adjusting the height of individual rollers of an in-line roller-skate. An axle bearing is located eccentrically within a rotateable bushing, which moves relative to the skate frame by means of a lockable lever, to raise or lower a skate wheel. By raising one or more skate wheels, other wheels no longer contact the ground, thus enabling the skater to execute turns more quickly. This arrangement may be desirable for certain applications such as figure skating or stunt skating, however, for most general applications a more stable and rugged construction having all wheels in contact with the ground is desired.

Such an arrangement is envisioned by U.S. Pat. No. 5,257,793 to Fortin. Fortin describes a skate assembly having a telescopic member mounted to the heel of the skate boot to allow adjustment of the boot's angle relative to the floor or ice. The telescopic member is extended and retracted by rotating a threaded cylinder which engages a threaded pedestal fixedly mounted to the skate's heel. It has been discovered that in operation, the Fortin device creates undesirable stresses and bending moments in the device's elements. Analyzing the Fortin skate as a three-link mechanism (the blade member, the boot, and the threaded cylinder) with two pin joints (heel end of blade member to threaded cylinder, toe end of blade member to toe end of boot), and one slide joint (heel end of boot to threaded cylinder), by Gruebler's equation:

$$\begin{aligned} \text{Degrees of Freedom} = F &= 3(n-1) - 2f_1 \\ &= 3(3-1) - 2(3) \\ &= 6 - 6 = 0 \end{aligned}$$

where n is the number of links and $f_1$ is the sum of pin and slide joints, shows the Fortin device to possess zero degrees of freedom. See Arthur G. Erdman and George N. Sandor, 1 MECHANISM DESIGN: ANALYSIS AND SYNTHESIS, 16–24 (Prentice-Hall 1984). Thus, raising the skate's heel by extending the threaded cylinder of the Fortin skate causes stresses within the device's elements and a bending moment on the skate boot. This bending moment is generally not problematic when the Fortin device is applied to skates having traditional flexible leather boots. Modern skates, however, are often constructed with a rigid plastic boot for increased ankle support and impact protection. If the Fortin device is used with these rigid boots, unacceptable stress damage to the boot or the mechanism can result.

SUMMARY OF THE INVENTION

Briefly described in a preferred form the present invention comprises a skate having a height adjustment mechanism with a wedge-shaped element for raising or lowering the skate boot's heel, thus changing the boot's angle of orientation with the floor or ice and shifting the skater's center of gravity. The height adjustment means of the present invention may be utilized in conjunction with any type of ice or roller skate, and may be quickly and easily adjusted without the necessity of removing the skate from the skater's foot.

In one embodiment, the skate of the present invention includes a boot having a sole, a toe end and a heel end. The boot is typically provided with laces or clamping means for securing the boot to the skater's foot. The front end of the skate's wheel support or blade element is supported from a hinged connection extending downwardly from the toe end of the skate boot to the front end of the wheel support or blade element, while a height adjustment mechanism connects the heel end of the boot to the rear end of the wheel support or blade element. By extending or retracting the height adjustment mechanism, the skate blade or wheel support pivots about the hinged joint at the toe end of the skate, thus varying the angle between the boot and the skate blade or wheel support.

The height adjustment mechanism operates by means of a movable wedge-shaped element which slides along an inclined surface of a stationary lifting element connected to the skate boot. The movable wedge moves within a carriage yoke which is hingedly connected to the skate blade or wheel support. An adjustment screw preferably slidably couples the movable wedge to the carriage yoke, enabling the wedge to translate horizontally forward or rearward, thus lifting or lowering one end of the skate boot vertically. Analyzing the skate of the present invention as a four-link mechanism (the blade member, the boot and stationary lifting element, the carriage yoke, and the movable element) with two pin joints (heel end of blade member to carriage yoke, toe end of blade member to boot) and two slide joints (stationary lifting element to movable element, movable element to carriage yoke), by Gruebler's equation:

$$\text{Degrees of Freedom} = F = 3(n-1) - 2f_1 = 3(4-1) - 2(4) = 9 - 8 = 1$$

where n is the number of links and $f_1$ is the sum of pin and slide joints, indicates a device having a single degree of freedom, that of the desired height adjustment. See Arthur G. Erdman and George N. Sandor, 1 MECHANISM DESIGN: ANALYSIS AND SYNTHESIS, 16–24 (Prentice-Hall 1984). When the motion of the movable wedge is constrained, however, the skate is an essentially rigid structure having zero degrees of freedom.

Thus, it is an object of the present invention to provide a skate with height adjustment means which enables the skater's center of gravity to be shifted forward or rearward, as desired.

It is another object of the present invention to provide a height adjustment mechanism for a skate which is durable and reliable in operation, simple in construction, and economical in manufacture.

These and other objects, features, and advantages of the present invention will become more apparent upon reading the following specification in conjunction with the accompanying drawing figures.

DESCRIPTION OF THE DRAWING FIGURES

FIG. 1*a* is a side elevational view of a skate according to a preferred form of the present invention, and including a wedge-shaped height adjustment means.

FIG. 1*b* shows a second embodiment of the present invention, having the support element and height-adjustment elements reversed in position from the embodiment shown by FIG. 1*a*.

FIG. 1*c* shows a third embodiment of the present invention having a blade suitable for ice skating.

FIG. 2*a* is a side elevational view showing the height adjustment mechanism of FIG. 1 in greater detail.

FIG. 2*b* is a rear elevational view of the height adjustment mechanism of FIG. 2*a*.

DETAILED DESCRIPTION

Figure 1A:
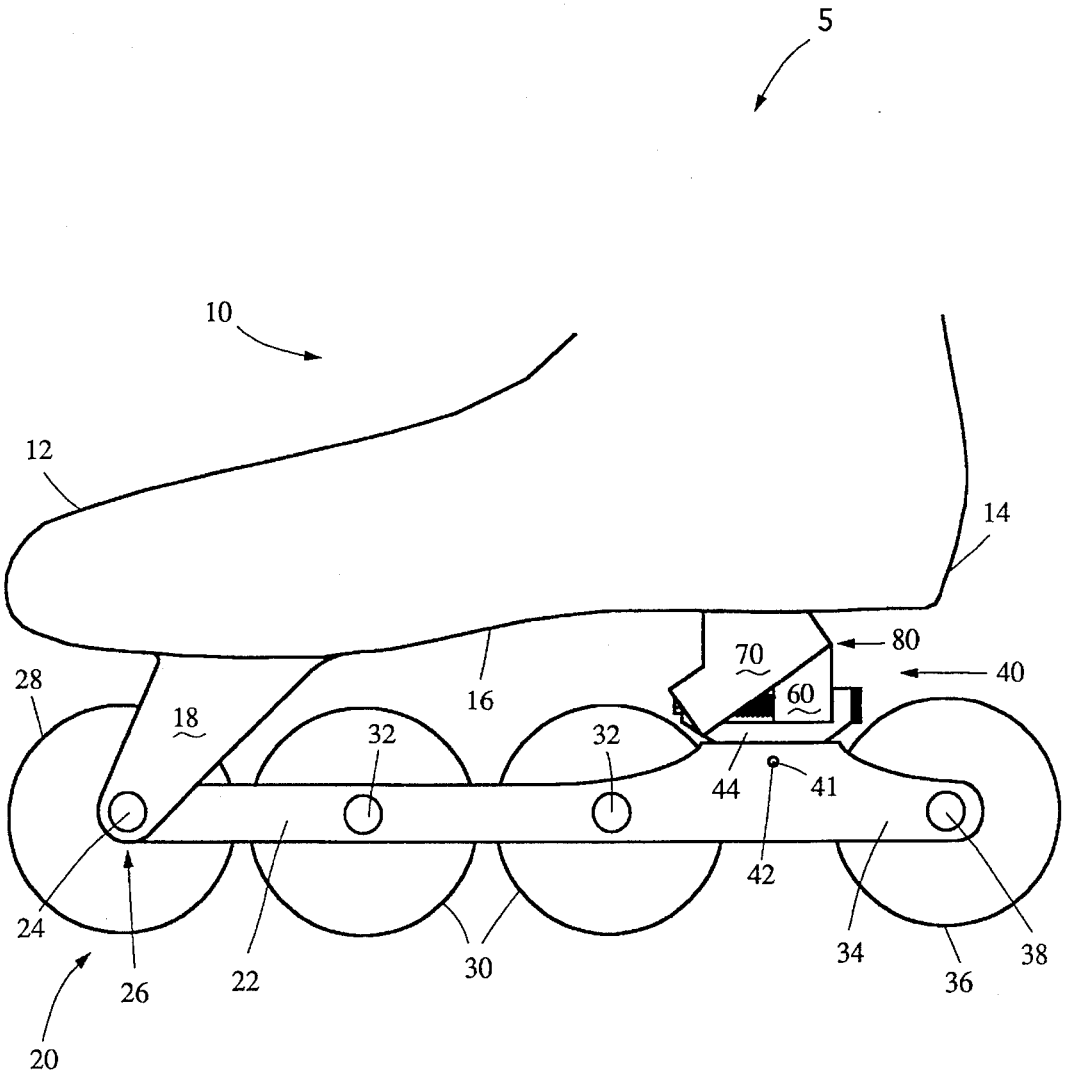

Referring now in detail to the drawing figures, wherein like reference numerals represent like parts throughout the several views, FIG. 1 shows a skate 5 including a boot 10, a wheel assembly 20, and a height adjustment mechanism 40. For purposes of illustration, the skate 5 is shown as an in-line roller-skate, with wheels for rolling in contact with the ground. It will be clear to those skilled in the art, however, that a similar arrangement can be provided for other types of roller-skates or a variety of ice-skate designs by replacing the wheel assembly 20 with other types of skate assemblies. Boot 10 is hingedly connected to the wheel assembly 20, preferably at its toe end by a toe-end pivot joint 26. By actuating the height adjustment mechanism 40, as will be more fully discussed hereinafter, the heel 14 of boot 10 is raised or lowered relative to the wheel assembly 20. By varying the angle between the boot 10 and the wheel assembly 20 in this manner, the skater's center of gravity is shifted forward or rearward.

Boot 10 is of typical construction, and preferably is fabricated from leather, plastic or vinyl. Boot 10 is constructed to conform comfortably to the contours of the skater's foot, provide ankle support, and protect the foot from external impacts and weather conditions. Boot 10 can be provided with lacing means, clamps, or other means for securing the boot 10 to the skater's foot. Boot 10 has a toe-end 12, a heel 14 longitudinally distal from the toe-end, and a sole 16. Sole 16 may be fabricated as an integral part of the boot 10, or may be fabricated separately and attached as by stitching, adhesives, or other standard attachment means. Sole 16 is fabricated from plastic or other material of sufficient structural strength to provide solid and secure attachment for the wheel assembly 20 and the height adjustment mechanism 40.

Figure 1B:
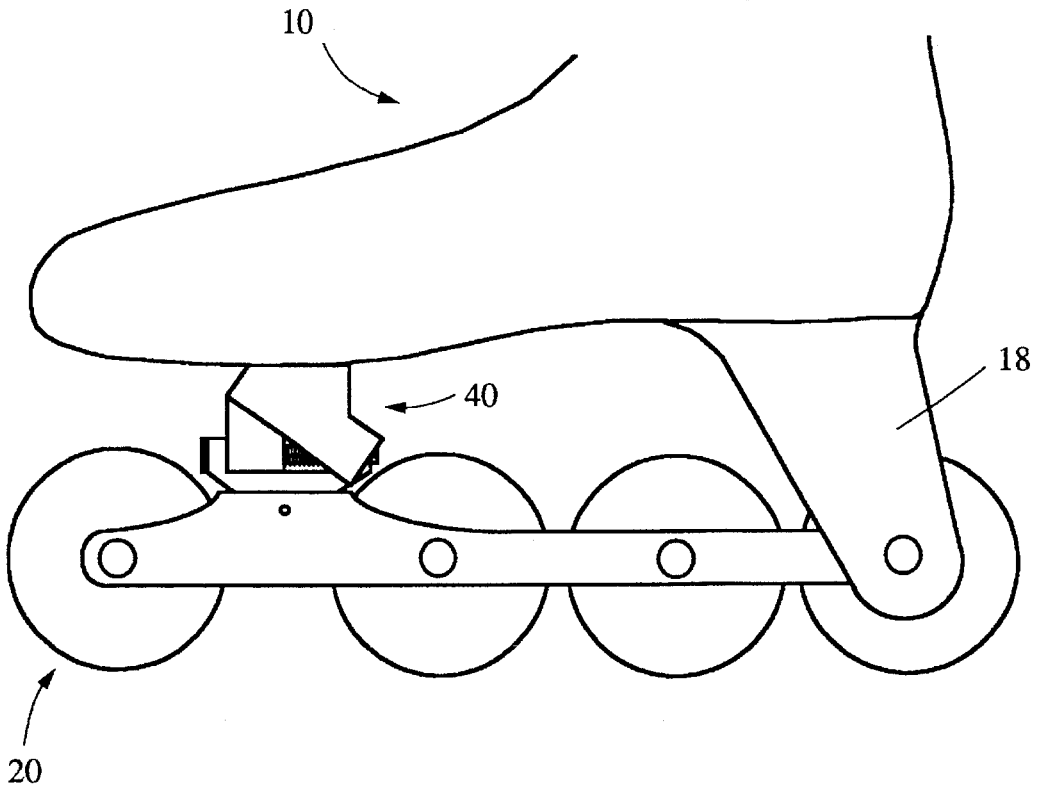
Figure 1C:
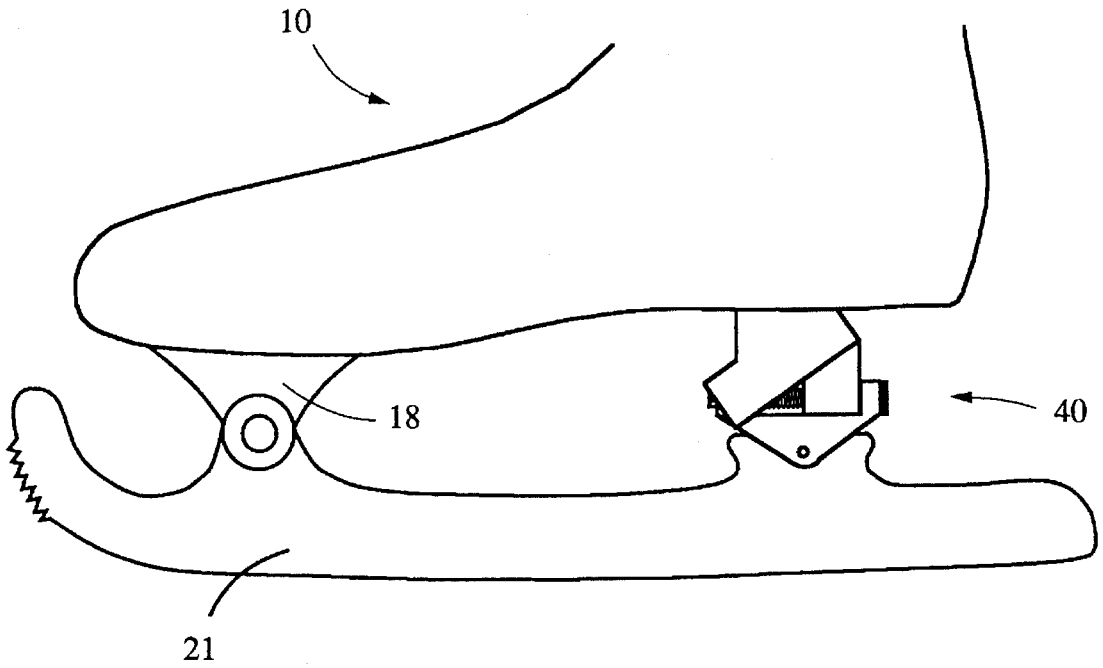

Wheel assembly 20 is connected to the toe-end 12 of boot 10 by a support strut 18. Support strut 18 may be fabricated as an integral part of the sole 16, or may be attached thereto by rivets, screws, or other attachment means. Support strut 18 is fabricated from steel, aluminum, plastic or other structural material of sufficient strength and rigidity. In the embodiment of an in-line roller-skate, the support strut 18 is preferably U-shaped in cross-section with an open end facing towards the toe-end 12 of boot 10 to accommodate a front wheel 28. In the alternative embodiment of an ice-skate, the support strut 18 can be a single, flat element hingedly connected to the skate blade 21 at the end of support strut 18 distal the boot 10 as shown by FIG. 1*c*. As illustrated in FIG. 1, in the embodiment of an in-line roller-skate, from axle 24 of front wheel 28 can also serve as the fulcrum of toe-end pivot joint 26 which hingedly couples the support strut 18 to the wheel assembly 20.

In the pictured embodiment of the present invention, a wheel assembly 20 extends generally horizontally beneath the sole 16 of boot 10, from toe-end pivot joint 26 to a point below heel 14. Although an in-line roller-skate is shown by FIG. 1*a*, it will be clear to those skilled in the art that other embodiments of the present invention can substitute other ground-contacting elements such as an ice-skate blade 21, as shown by FIG. 1*c*, or some other roller assembly in place of the in-line wheel assembly 20. As shown in FIG. 1, wheel assembly 20 includes a wheel support arm 22 hingedly connected to support strut 18 by toe-end pivot joint 26 at the toe-end 12 of boot 10. The heel 14 of boot 10 is supported above the distal end of wheel support arm 22 by a height adjustment mechanism 40 which is more fully described hereinafter. Wheel support arm 22 can include a short cantilever 34 extending beyond height adjustment mechanism 40, rearward to support rear wheel 36 on rear axle 38. Wheel support arm 22 may be constructed as a single element with openings provided therein to house front wheel 28, middle wheels 30 and rear wheel 36. Alternatively, wheel support arm 22 may comprise a pair of thin elements arranged along either side of the wheels and connected together by front axle 24, wheel axles 32 and rear axle 38. Wheel support arm 22 is preferably fabricated from steel, aluminum, plastic, or other material of sufficient structural integrity. Wheel assembly 20 also preferably includes two middle wheels 30 arranged between the front wheel 28 and the rear wheel 36. Middle wheels 30 spin about wheel axles 32 which are anchored to wheel support arm 22 on either side of middle wheels 30. Front wheel 28, middle wheels 30 and rear wheel 36 typically include bearings (unshown) which enable the wheels to spin freely about their respective axles.

A height adjustment mechanism 40 supports the heel 14 of boot 10 above the wheel assembly 20 and allows the heel 14 to be raised and lowered relative to the wheel assembly 20. The height adjustment mechanism 40 preferably includes a carriage yoke 44, a wedge-shaped movable element 60, an adjustment screw 54, and a stationary lifting element 70 as shown in greater detail by FIGS. 2–4. Height adjustment mechanism 40 is connected at its lower end to the wheel assembly 20 by a pivot pin 42 which extends through a pin opening 41 in wheel support arm 22 thereby allowing height adjustment mechanism 40 to pivot in a plane parallel to the central axis of wheel assembly 20. Pivot pin 42 is preferably fabricated from steel or other structural material, as it will bear a substantial portion of the skater's weight. The bearing hole 46 through carriage yoke 44 is of a diameter which will allow a clearance fit with pivot pin 42, such that carriage yoke 44 pivots freely about pivot pin 42. Pin opening 41 is preferably dimensioned to create an interference fit with pivot pin 42 such that pivot pin 42 remains in place once installed. Alternatively, the ends of pivot pin 42 may be flared or welded once installed, to prevent the removal of pivot pin 42.

Figure 3:
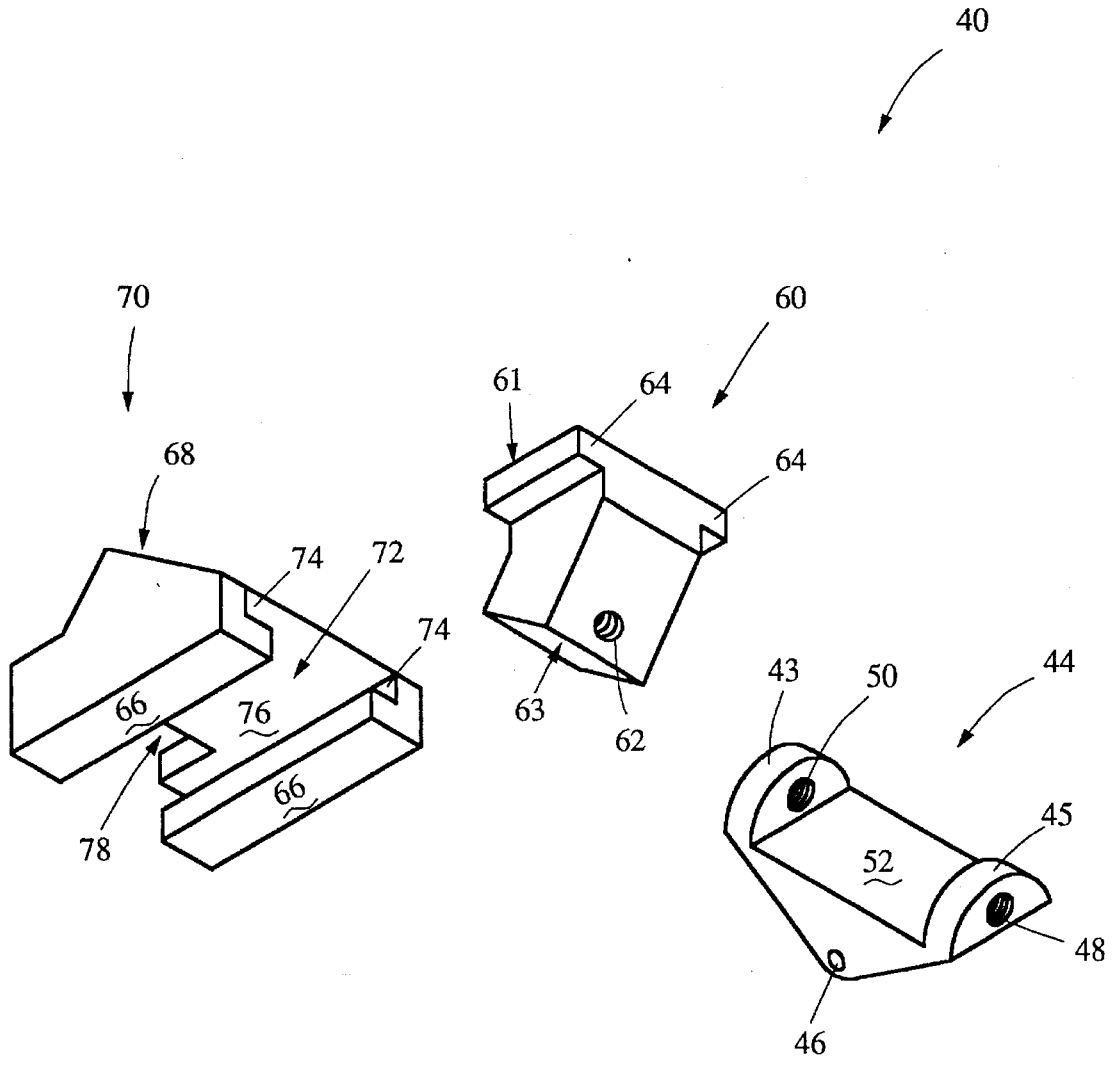
FIG. 3 is an exploded view of the height adjustment mechanism of FIG. 1.
Figure 4:
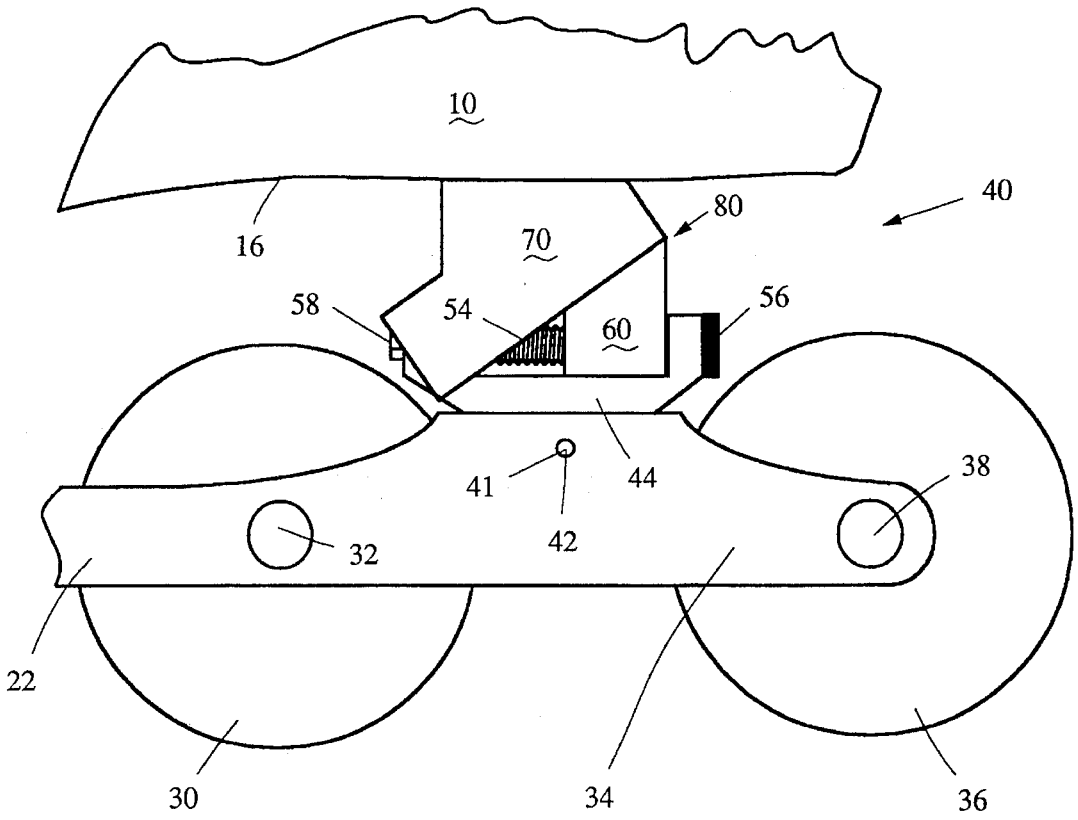
FIG. 4 is a side elevational view of the height adjustment mechanism mounted to a skate according to a preferred form of the present invention, shown in detail.

As shown in FIG. 3, carriage yoke 44 is preferably a triangular prismatic element with a flat rectangular top platform 52. The carriage yoke 44 is connected at its lower comer 47 to wheel support arm 22 by pivot pin 42, as described above. A pair of semi-circular dogs 43, 45 project upward from carriage yoke 44 on either end of platform 52, with front dog 43 being the toe-end of carriage yoke 44 and rear dog 45 being the heel end of carriage yoke 44. Rear clearance hole 48 and forward clearance hole 50 extend through rear dog 45 and front dog 43 respectively, to receive a threaded adjustment screw 54 which moves movable element 60 longitudinally along platform 52 between rear dog 45 and front dog 43, and retains movable element 60 in a stationary position when the skate is in use.

Figure 5:
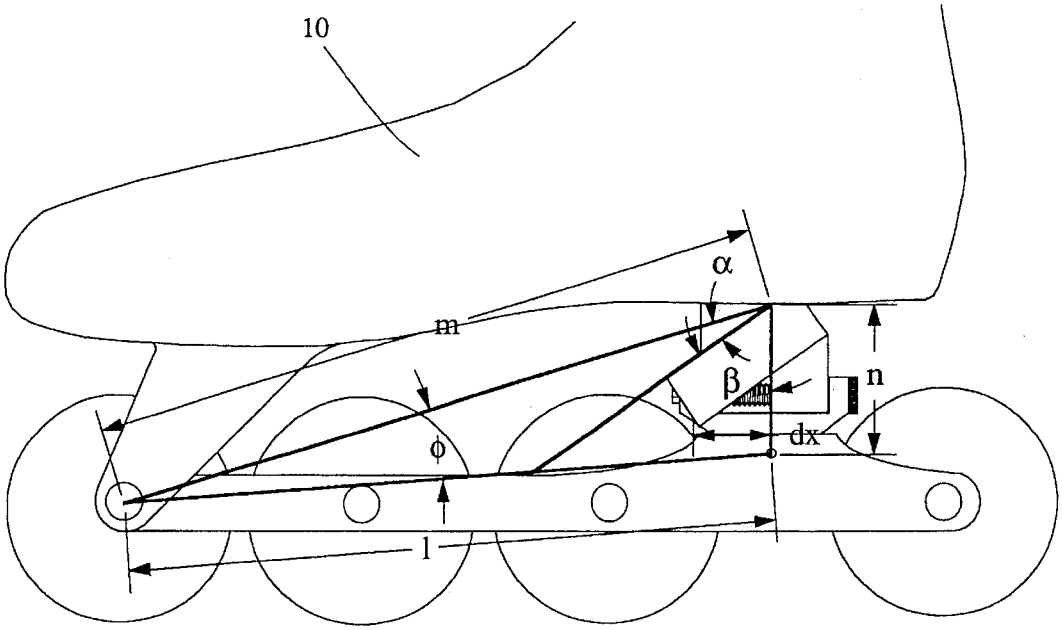
FIG. 5 is a side elevational view of the skate of FIG. 1 showing angles of inclination and dimensions necessary for calculation of the skate's range of motion.

Movable element 60 is a prismatic element, generally wedge-shaped, and having an inclined top surface 61. The angle of inclination of inclined top surface 61 is selected to maximize the range of vertical travel of heel 14 resulting from the horizontal motion of movable element 60 along platform 52, while still providing sufficient structural stability and smooth operation of the mechanism. This may be achieved by calculating the angles of inclination as shown in FIG. 5. Applicant has developed a working prototype of the invention, and has found that for the given dimensions of the prototype, height adjustment mechanism 40 operates best when the angle of inclination of movable element 60 is approximately 35°. It has been found that a range of motion of approximately 5° upward from horizontal is provided for the boot 10 by providing movable element 60 with an angle of inclination of approximately 35° measured from the horizontal bottom surface 63, and a height 65, such that boot 10 is generally horizontal when movable element 60 is fully retracted to contact rear dog 45. In general, increasing the angle of inclination reduces stress in the threaded adjustment screw 54 and increases the vertical range of motion. In the described embodiment, the specified 35° angle of inclination is the maximum permitted by the limited space between heel 14 and platform 52.

By varying the height 65 of movable element 60, different ranges of motion can be obtained. For example, by installing a movable element of somewhat greater height than is depicted in the figures, a range of motion for boot 10 of 5° from horizontal to 10° from horizontal can be achieved in the described embodiment. Thus it is possible to provide interchangeable movable elements of a variety of heights, enabling a continuum of ranges of motion.

A threaded opening 62 through the bottom of movable element 60 receives adjustment screw 54 such that the bottom surface 63 of movable element 60 moves longitudinally along the platform 52 of carriage yoke 44 when the threaded adjustment screw 54 is turned. Threaded adjustment screw 54 is installed through the rear clearance hole 48 of carriage yoke 44, in the direction of arrow 55. Adjustment screw 54 is then threaded through threaded opening 62 of movable element 60 and then through forward clearance hole 50 of carriage yoke 44. Rear clearance hole 48 and forward clearance hole 50 are of a diameter larger than the outer thread diameter of adjustment screw 54, such that the threads of adjustment screw 54 turn freely within, and do not engage, rear clearance hole 48 or forward clearance hole 50. A lock nut or other suitable end retainer 58 is installed on the end of the adjustment screw 54 which extends through forward clearance hole 50 to prevent adjustment screw 54 from being withdrawn from forward clearance hole 50. A knob 56 is preferably provided on the other end of adjustment screw 54 to facilitate turning of adjustment screw 54 and to prevent adjustment screw 54 from being drawn through rear clearance hole 48. The threads of adjustment screw 54 engage mating threads tapped within threaded opening 62, such that when adjustment screw 54 is turned, movable element 60 will translate along platform 52 of carriage yoke 44 between dogs 45 and 43. The threads of adjustment screw 54 are of a pitch and height selected to allow smooth operation of the mechanism and provide the necessary structural integrity. When adjustment screw 54 is not mined, for example, while the skate is in use, the threads of adjustment screw 54 retain the movable dement in place. The pitch of the threads is selected such that the skater's weight will not cause movable element 60 to shift during operation. Thus, adjustment screw 54 functions both as an adjustment means for positioning movable element 60, and as a retaining means for holding movable element 60 in place.

Figure 6:
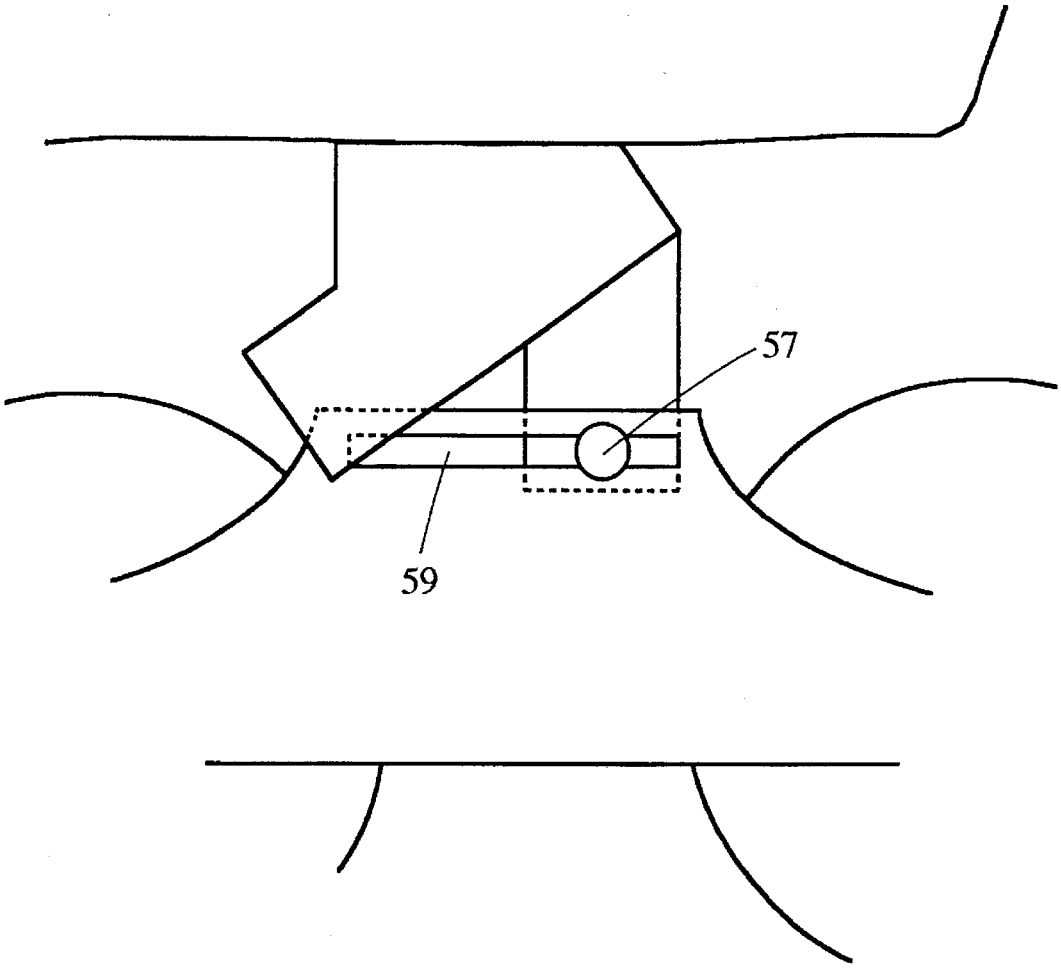
FIG. 6 shows an alternative embodiment of the height adjustment mechanism.

In an alternative embodiment shown by FIG. 6, adjustment screw 54 may be eliminated, with movable element 60 being positioned manually on carriage yoke 44, and retained in place by a position locking means such as a set screw 57. In this embodiment, movable element 60 is maintained in contact with carriage yoke 44 by retaining means such as a slot 59, which allows relative sliding motion between movable element 60 and carriage yoke 44.

The inclined top surface 61 of movable element 60 is preferably provided with keys 64 projecting outward from the sides of movable element 60 along the inclined top surface 61. These outwardly projecting keys 64 engage and slide within channel 74 of the stationary lifting element 70 thus holding movable element 60 in juxtaposition with stationary lifting element 70. Thus, as movable element 60 moves along platform 52, its inclined top surface 61 acts to raise or lower stationary lifting element 70.

Stationary lifting dement 70 is a prismatic element having an upper surface 68 which is connected by standard attachment means to the sole 16 of boot 10 near heel 14 as shown by FIG. 1. Stationary lifting element 70 is of a shape which will allow its bearing surface 76 to align with the inclined top surface 61 of movable element 60 along slide joint 80. A cutout 78 in the bearing surface 76 provides clearance for adjustment screw 54 to be placed through the stationary lifting element 70. A slot 72 is provided in lower surface 66 of stationary lifting element 70 to allow clearance for movable element 60 as it is moved throughout its range of adjustment. Channels 74 along the upper edge of slot 72 engage the keys 64 projecting from the inclined top surface 61 of movable element 60, such that the keys are constrained to slide within channels 74. Stationary lifting element 70 could be formed as an integral part of boot 10 by providing a suitable bearing surface on heel 14 for contacting movable element 60.

Assembly and Operation

Figure 2A:
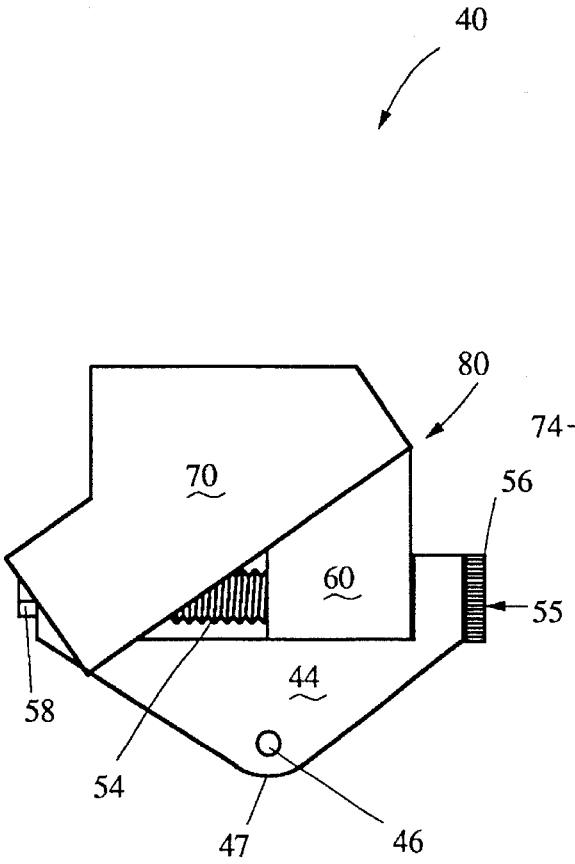
Figure 2B:
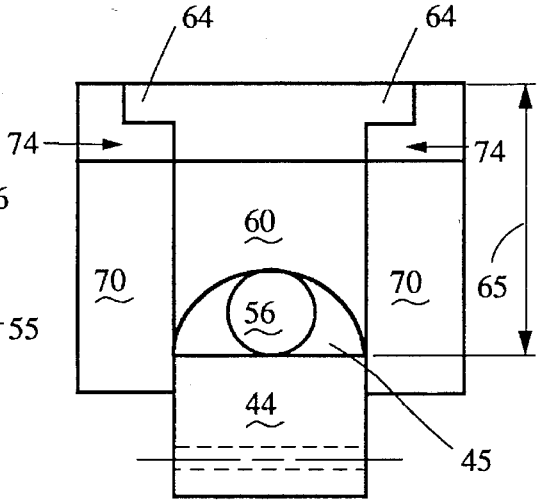

The above-described embodiment of the skate of the present invention may be assembled by the following sequence of operations: Support strut 18 is attached to toe end 12 of sole 16 of the boot 10. Stationary lifting element 70 is attached to the sole 16 of boot 10 near heel 14 as shown by FIG. 1. Wheel assembly 20 is attached to the support strut 18 at the toe-end pivot joint 26. The keys 64 of the movable element 60 are inserted into the channel 74 of stationary lifting element 70 as shown in FIGS. 2*a* and 2*b*. The platform 52 of carriage yoke 44 is placed in contact with the bottom surface 63 of movable element 60, such that movable element 60 is oriented between dogs 45 and 43. Rear clearance hole 48 of the carriage yoke 44 is aligned with the threaded opening 62 of movable element 60. The adjustment screw 54 is inserted through rear clearance hole 48, through the threaded opening 62 of movable element 60, and through forward clearance hole 50 of the carriage yoke 44. The end retainer 58 is installed on the end of adjustment screw 54 extending through forward clearance hole 50. The wheel assembly 20 is pivoted about the toe-end pivot joint 26 until the pin opening 41 through wheel support arm 22 aligns with beating hole 46 in carriage yoke 44. Pivot pin 42 is inserted through pin opening 41 and beating hole 46 to complete the assembly.

In operation, the skater adjusts height adjustment mechanism 40 to vary the skate's angle of orientation with the floor or ice, thus shifting of the skater's center of gravity as desired. The skater may adjust the height adjustment mechanism 40 before donning the skates or while wearing them, so long as the skater's weight is not being applied to the skate. To shift the skater's center of gravity forward, the skater turns knob 56 such that the thread of adjustment screw 54 moves movable element 60 linearly toward the toe end 12 of the skate. As the movable element 60 moves forward, its inclined top surface 61 raises stationary lifting element 70 in a direction away from wheel assembly 20. The wheel assembly 20 thus pivots about toe-end pivot joint 26, moving the cantilevered end 34 of wheel assembly 20 away from the heel 14 of boot 10. In this manner, when the skater places wheels 28, 30, 36 on the skating surface the boot 10 is inclined relative to the skating surface, with the skater's heel being elevated above his or her toes. To shift the skater's center of gravity rearward, adjustment screw 54 is merely turned in the opposite direction, causing movable element 60 to move linearly towards heel 14 of boot 10, thus lowering the skater's heel.

The change in angular orientation of boot 10 for a given distance of longitudinal displacement of movable element 60 can be calculated as follows:

$$d\phi = \sin^{-1}\left(\frac{m}{l}\sin\alpha + \frac{n + dx\cot\beta}{l}\sin\beta\right) -$$

-continued $$\sin^{-1}\left(\frac{m}{l}\sin\alpha + \frac{n}{l}\sin\beta\right)$$

where $d\phi$ is the change in angular orientation of boot 10, dx is the longitudinal displacement of movable element 60, and the other angles and distances are as shown by FIG. 5.

While the preferred arrangement of the height adjustment mechanism 40 has been described, it will be clear to those in the art that a number of modifications are possible. For example, the positions of height adjustment mechanism 40 and support strut 18 could be switched, as shown by FIG. 1*b*, such that wheel assembly 20 is pivoted about a support mounted to the heel end of boot 10, with height adjustments being made at the boot's toe end. Likewise, height adjustment mechanism 40 could be rotated 180° such that knob 56 faced the toe end 12 of the skate. Additionally, the positions of the movable element 60 and the stationary lifting element 70 could be inverted, such that the movable element 60 was oriented on top of the stationary lifting element 70. It will also be clear to those skilled in the art that by varying the shapes and sizes of stationary lifting element 70 or movable element 60, or by adjusting the length of support strut 18, that a variety of adjustment ranges for the orientation of boot 10 with respect to wheel assembly 20 may be obtained.

While the invention has been disclosed in a preferred form, it will be apparent to those skilled in the art that these and many other modifications, additions, and deletions can be made therein without departing from the spirit and scope of the invention and its equivalents as set forth in the following claims.

What is claimed is:

1. A skate comprising:

(a) a boot having a toe-end, a heel-end which is positioned along a longitudinal axis from said toe-end, and a sole;

(b) a skate assembly having at least one ground-contacting element;

(c) a support element for supporting one end of said boot on said skate assembly, said support element pivotally connecting said one end of said boot to said skate assembly to permit longitudinal pivoting between said toe-end and said heel-end of said boot;

(d) a height-adjustment and support assembly for adjustably connecting the other end of said boot to said skate assembly and for adjusting the height of said other end of said boot relative to said skate assembly, said height-adjustment and support assembly comprising a movable element and a stationary element, each element having a surface that is inclined from the longitudinal axis of said boot;

(e) means for holding said inclined surfaces of said movable and stationary elements in juxtaposition while permitting said inclined surface of said movable element to move linearly relative to said stationary element, so as to adjust the height of said other end of said boot relative to said skate assembly; and (f) adjustment means connected to said movable element for effectuating linear movement of said movable element relative to said stationary element, so as to adjust the height of said other end of said boot relative to said skate assembly.

2. The skate of claim 1 in which said ground-contacting element comprises a plurality of in-line wheels supported by at least one support arm.

3. The skate of claim 1 in which said movable element is a wedge with its inclined surface capable of sliding along said inclined surface of said stationary element.

4. The skate of claim 3 in which said height-adjustment and support assembly further comprises a carriage yoke for connecting said boot to said skate assembly, said carriage yoke having a flat surface and being pivotally connected to said skate assembly, with said wedge having a flat surface in juxtaposition to said flat surface of said carriage yoke.

5. The skate of claim 4 in which said carriage yoke has a toe dog and a heel dog between which said wedge slides linearly on said flat surface of said carriage yoke.

6. The skate of claim 5 in which said adjustment means is a threaded screw which passes through an aperture in said heel dog and a threaded aperture in said wedge and into an aperture in said toe dog, and when said screw is turned said wedge moves linearly in relation to said toe and heel dogs.

7. The skate of claim 1 in which said means for holding is a key and channel structure for holding said inclined surfaces in juxtaposition.

8. The skate of claim 1 in which said support element is located at said toe-end of said boot and is pivotally connected to said skate assembly.

9. The skate of claim 1 in which said ground-contacting element is a blade suitable for skating on ice.

10. The skate of claim 2 in which said height-adjustment and support assembly further comprises a carriage yoke pivotally connected to said at least one support arm, said carriage yoke having a flat surface in juxtaposition with said movable element.

11. The skate of claim 10 in which said carriage yoke has a toe dog and a heel dog between which said movable element slides linearly on said flat surface of said carriage yoke.

12. The skate of claim 11 in which said adjustment means is a threaded screw which passes through an aperture in said heel dog and a threaded aperture in said movable element and into an aperture in said toe dog, such that when said screw is turned said movable element moves linearly between said toe and heel dogs.

13. The skate of claim 1 in which said movable element of is detachable from said height-adjustment and support assembly so that said movable element can be readily interchanged for a movable element of a different height to adjust the height of said other end of said boot relative to said skate assembly.

14. A skate comprising:

(a) a skate assembly having a forward end and a rearward end positioned along a longitudinal axis from said forward end, said skate assembly including at least one ground-contacting element;

(b) a boot supported above said skate assembly and having a toe-end, a heel-end longitudinally opposite said toe-end, and a sole;

(c) a support element for supporting said toe-end of said boot above said forward end of said skate assembly, said support element having a first end rigidly connected to said toe-end of said boot, and a second end pivotally connected to said forward end of said skate assembly to permit longitudinal pivoting between said boot and said skate assembly;

(d) a height-adjustment and support assembly for supporting the heel-end of said boot above said rearward end of said skate assembly, said height-adjustment and support assembly including a carriage yoke pivotally connected to said skate assembly, and further including a wedge-shaped movable element having an inclined upper surface, said movable element having a flat lower surface which is linearly slidable along said carriage yoke for raising and lowering said heel-end of said boot relative to said skate assembly; and (e) threaded adjustment means for causing said movable element to slide linearly along said carriage yoke.

* * * * *